US005556467A

United States Patent [19]

Koskinen et al.

[11] Patent Number: 5,556,467

[45] Date of Patent: Sep. 17, 1996

[54] ASSEMBLY FOR LOADING A DOCTOR BLADE

[75] Inventors: Jukka Koskinen, Helsinki; Aaron Mannio, Järvenpää, both of Finland

[73] Assignee: Valmet Corporation, Helsinki, Finland

[21] Appl. No.: 228,861

[22] Filed: Apr. 18, 1994

[30] Foreign Application Priority Data

Apr. 16, 1993 [FI] Finland ..... 931722

[51] Int. Cl.[6] ..... B05C 11/04

[52] U.S. Cl. ..... 118/123; 118/126; 118/413; 427/356

[58] Field of Search ..... 427/356, 358; 118/123, 126, 410, 413, 419

[56] References Cited

U.S. PATENT DOCUMENTS

| | | | |
|---|---|---|---|
| 3,335,701 | 8/1967 | Verkinderen et al. | 118/247 |
| 4,375,202 | 3/1983 | Miller | 118/117 |
| 4,440,105 | 4/1984 | Jeltema | 118/410 |
| 4,553,498 | 11/1985 | Sommer et al. | 118/126 |
| 5,085,168 | 2/1992 | Sollinger | 118/126 |
| 5,138,970 | 8/1992 | Sollinger | 118/126 |

FOREIGN PATENT DOCUMENTS

| | | | |
|---|---|---|---|
| 0352440 | 1/1990 | European Pat. Off. . | |
| 2822682 | 11/1979 | Germany | 118/126 |
| WO93/05887 | 4/1993 | WIPO | 118/126 |

*Primary Examiner*—Katherine Bareford

*Attorney, Agent, or Firm*—Cohen, Pontani, Lieberman, Pavane

[57] ABSTRACT

This invention relates to a method and assembly for loading the doctor blade of a doctoring unit used, e.g., in coating a paper web, characterized in that the blade can be loaded close to the edge of the blade without compromising the accuracy of blade profile control. The blade is loaded by backing member (8) having a Z-shaped cross section in which one side of the section forms a base (13), while the middle part forms a waist (18) which turns toward the base (13), and the other side of the shape forms a tip (12) pointing to an opposite direction relative to the base (13) and has at its end a tapering edge suited for pressing against the doctor blade (7). This approach is capable of eliminating the sliding movement of the backing member (8) relative to the blade which tends to impair the accuracy of blade pressure control.

27 Claims, 2 Drawing Sheets

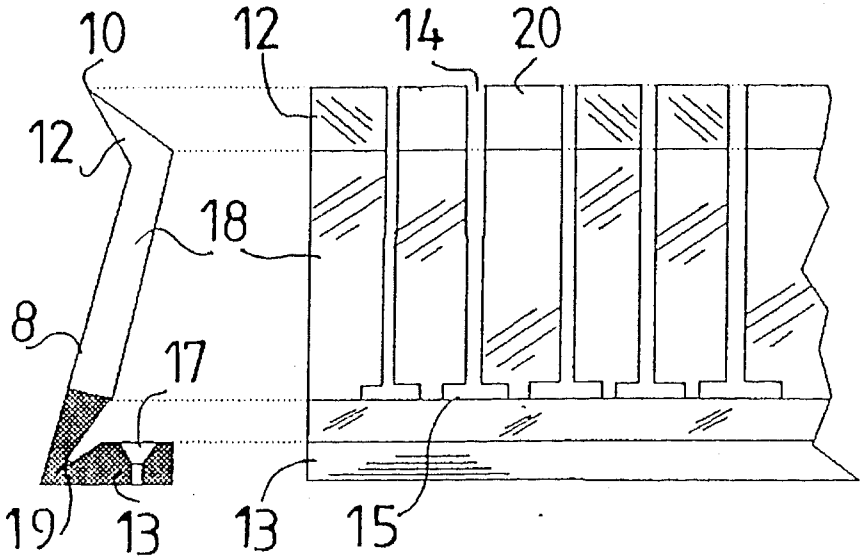
Fig. 3
Fig. 2
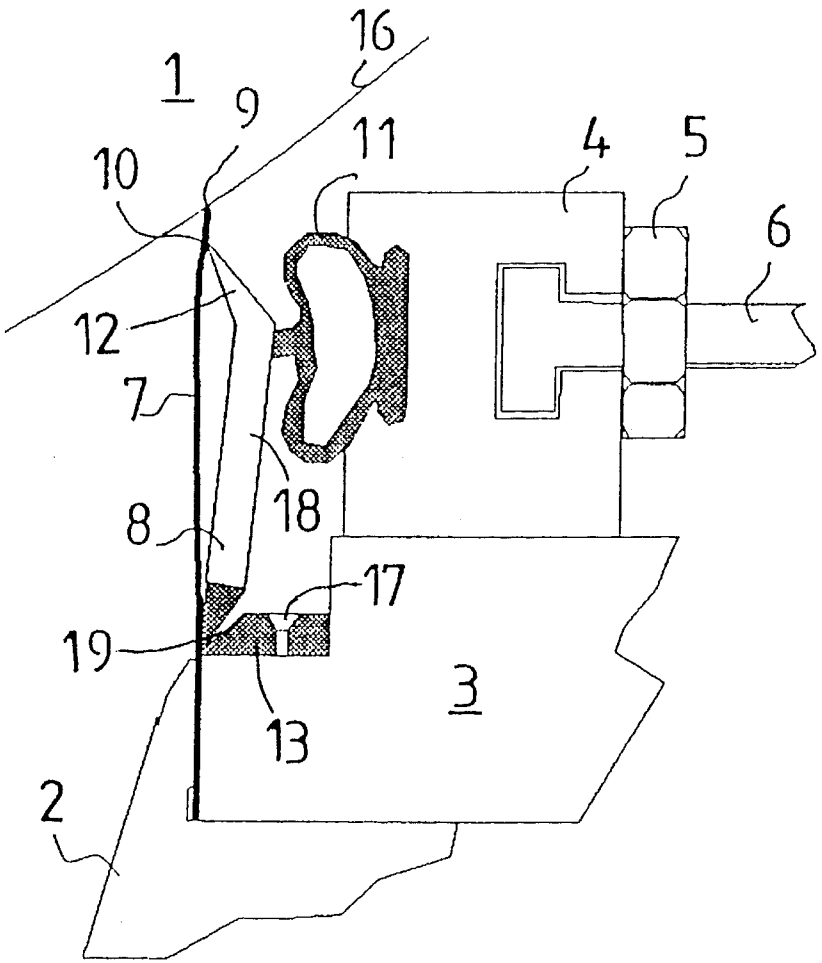
Fig. 1

ASSEMBLY FOR LOADING A DOCTOR BLADE

BACKGROUND OF THE INVENTION

The present invention relates to a method for loading the blade of a doctoring unit used for coating, e.g., a paper web.

The invention also concerns an assembly for loading a doctor blade of a coater apparatus.

In coating of a paper web, the coat is smoothed onto the web most commonly using a doctor blade. The coat mix can first be applied onto the web using a separate applicator apparatus, whereby the doctor blade is placed at a distance in the machine direction from the point of application, or alternatively, a coating machine called a short-dwell coater can be used in which an application chamber is situated immediately beside the doctor blade and the applied coat is smoothed immediately by the doctor blade.

The amount of coat mix adhering to the web being coated is adjusted by altering the loading of the doctor blade. When the blade loading is altered, the actual angle of the doctor blade to the web also changes, and the control of applied coat weight is temporarily unstable. This relates to the fact that the blade is contoured conformant with the web at the previously used blade tilt angle, and after the change of this angle, a certain time must elapse before the blade tip again wears conformant with the web. Changes in blade angle also cause other coat defects such as bleeding and uneven coat thickness. To avoid such defects, different types of systems have been developed suited for maintaining the blade angle as constant as possible irrespective of changes in blade loading.

A change in the doctor blade angle can be compensated for by either deflecting the blade so that the blade tip angle will not change, or alternatively, rotating the doctor blade support beam about the blade tip edge by an incremental angle corresponding to the change in the blade angle. Such a constant-angle control is easy to implement in doctor blade units removed from the applicator apparatus, because the doctor blade support beam does not carry other equipment related to the coating process. In the short-dwell coating process, the use of blade-deflecting arrangements is awkward, because the required apparatuses are difficult to adapt in conjunction with the extremely compact construction of the short-dwell coater. Therefore, the blade angle in short-dwell coaters is simply controlled by rotating the doctor blade support beam about the edge of the blade tip. Also in this manner the control of the blade angle in short-dwell coaters is complex, because when the doctor blade support assembly is rotated about the edge of the blade tip, the gap of the coat metering edge of the applicator chamber to the web changes at the ingoing side of the web to the chamber. Obviously, this also changes the conditions in the applicator chamber and may permit the entry of air past the metering edge into the applicator chamber, which causes coat defects. Therefore, when doctor blade loading is changed in a short-dwell coater, the doctor blade support beam should also be rotated and simultaneously the coat metering edge adjusted, which operations are extremely cumbersome to implement and thus cannot provide a satisfactorily operating constant-angle doctor blade arrangement for a short-dwell coater. Major difficulties will also be encountered in designing the end dams, which control the coat width, so that they operarate compatibly with the blade tip angle changes.

However, the tip angle of the doctor blade to the web being coated can be held constant extremely well, independently of blade loading changes if the doctor blade is loaded close to its tip. Such apparatuses are already in use and, e.g., U.S. Pat. No. 4,440,105 discloses a short-dwell coater in which the doctor blade is loaded by means of a separate loading blade close to the doctor blade tip. The loading blade resembles the doctor blade in that it is a flexible blade pressed against the doctor blade by means of a resilient loading hose. While this design attains constant-tip-angle loading of the doctor blade with relatively good accuracy, it still has several drawbacks. During adjustment, the flexible blade slides along the rear surface of the doctor blade, and the friction causes uneven movement between the blades which disturbs blade control. Moreover, control of doctor blade profile by means of the flexible backing blade is difficult.

SUMMARY OF THE INVENTION

It is an object of the present invention to achieve a loading method of a doctor blade, said method permitting loading the blade close to its tip without compromising the control of the blade. A further object of the invention is to achieve a method in which the doctor blade tip angle can be held constant even during the control of the doctor blade profile. Another further object of the invention is to achieve a loading method which besides the above-mentioned benefits provides the control of the doctor blade profile.

The invention is based on loading the doctor blade close to its tip by means of a backing member which is stiff in the vertical direction of the blade.

More specifically, the method according to the invention includes preventing the shifting of the loading force of the doctor blade in a vertical direction of the doctor blade.

Furthermore, the apparatus according to the invention is characterized by a backing member that is stiff in a vertical direction of the doctor blade so as to prevent shifting between the doctor blade and the backing member when the load of the doctor blade changes.

The invention offers significant benefits.

The principal benefit of the invention is that the tip angle of the doctor blade to the web stays constant during a change of the blade loading. Thus, the assembly according to the invention operates as a constant-tip-angle doctor blade, which provides the above-mentioned substantial benefits including substantially eliminating sliding movement between the doctor blade and the tip of the backing member. An extremely important benefit is that the blade profile can be changed without causing a change in the tip angle through dividing the backing member along its longitudinal axis into comb-like segments. This approach assures maximum control accuracy in conjunction with automatic blade profile control. By making in this manner the backing member resilient in the direction of the applied blade loading force, the bending stiffness and straightness errors of the backing member have no effect on the evenness of the coat profile. The structure of the blade backing member is extremely simple and easy to manufacture and mount in conjunction with the doctor blade. Owing to its simple structure, the backing member operates in an inherently reliable manner. The loading assembly according to the invention can be readily adapted to existing coating stations. Particularly advantageous is the use of the loading method according to the invention in short-dwell coaters in which the constant-tip-angle control can be implemented in a simple and cost-effective manner. Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views:

FIG. 1 is a sectional side view of a doctor blade having the blade loaded with a stiff backing member according to the invention;

FIG. 2 is a backing member according to the invention in a partially sectional end view; and FIG. 3 is a side view of the backing member shown in FIG. 2.

DETAILED DESCRIPTION OF THE PREFERRED EMBODIMENTS

Figure 4:
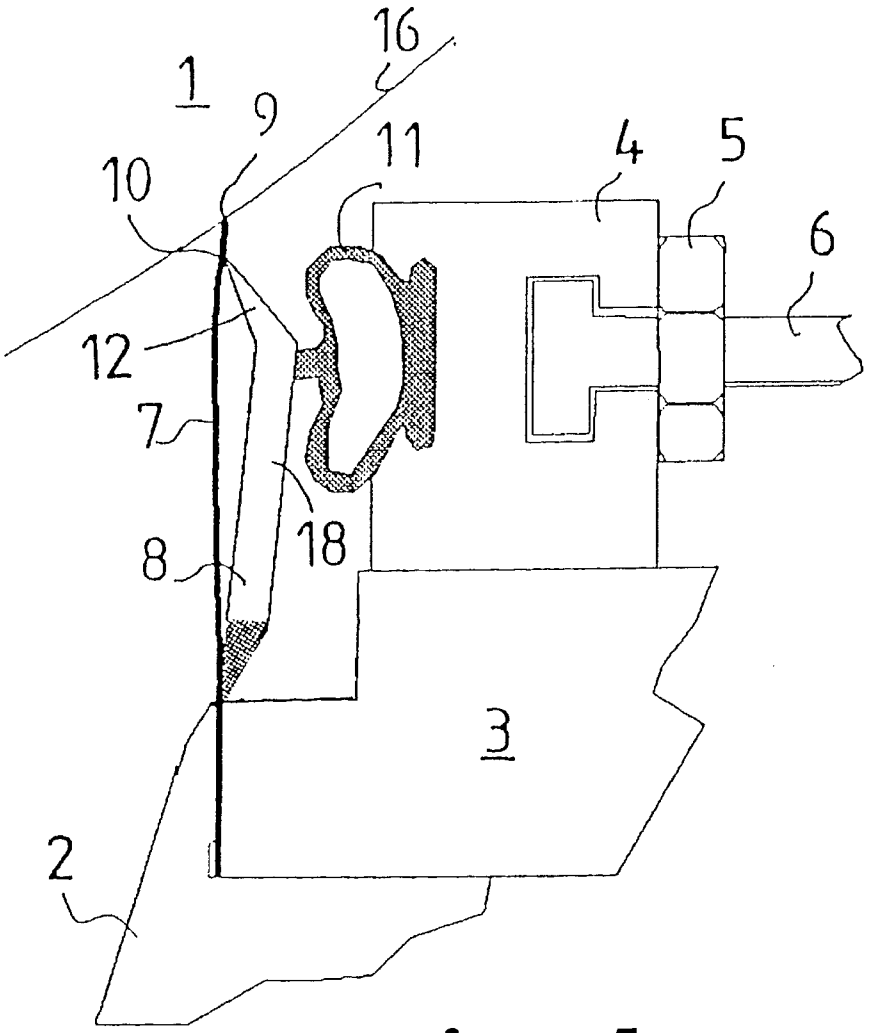
FIG. 4 is a sectional side view of another embodiment of the invention.

In this application, the vertical direction of the blade is the direction from the tip of the blade to the mounting point of the same.

With reference to FIG. 1, the structure shown therein can be used as the doctor blade of a short-dwell coater or the loading assembly of a separate doctor blade. As shown, a doctor blade 7 is mounted in a doctor blade support beam 2, 3 comprised of two beams, and the doctor blade 7 is loaded and supported very close to the tip edge or line 9 of the doctor blade by means of the tip 12 of a backing member 8. The web 16 to be coated passes in the conventional manner supported by a backing roll 1. The backing member 8 is pressed against the doctor blade 7 by means of an adjustable loading apparatus mounted on the upper beam 3 of the doctor blade support assembly. The loading apparatus comprises a blade profile control beam 4 divided into segments along its longitudinal axis. Each segment of the blade profile control beam 4 has a nut 5 fixed to the segment and an adjustment screw 6 cooperating via the nut 5 with the control segment. The backing member 8 is pressed against the doctor beam 7 by means of a pressure-loaded hose 11.

The backing member 8 can be made from a shaped steel section, for instance. In the preferred embodiment shown in the diagrams, the backing member section is essentially Z-shaped. The lower surface of the base 13 of the section is flat and has along the length of the base 13 a plurality of mounting holes 17 via which the backing member 8 is bolted in place. The mid portion 18 of the section turns toward the base 13, whereby the base 13 and the mid portion 18 form an acute angle. At the end of the mid portion 18, the section turns to form a tip 12 pointing upward and smoothly to an opposite direction relative to the base 13. The end of the tip 12 is tapered into an edge 10 acting as the backing-force-exerting line. A stiffness-reducing groove 19 is provided at the joining line of the base 13 of the backing member base 8 to its mid portion 18.

As shown in FIG. 3, the backing member 8 is divided along its longitudinal axis into segments 20 by crosswise cuts 14 extending from the tip 12 of the backing member 8. At the bottom of each cut is further fabricated a slot 15 which is aligned so as to transversely terminate the cut. The purpose of such cuts 14 and slots 15 is to make the backing member 8 extremely flexible in the loading direction of the doctor blade. The flexibility of the backing member 8 is additionally enhanced by a stiffness-reducing groove 19 at the joining line of the backing member base 13 to the mid portion 18. The cuts 14 and slots 15 can be filled with a suitable resilient sealant to avoid their fill-up by accumulated dirt. Suitable sealants are silicone and urethane polymers, for instance.

In the embodiment illustrated in FIG. 1, the backing member 8 is bolted through screw holes 17 in the base 13 of the section to the upper beam 3 of the doctor blade support assembly so that the edge formed by the base 13 and mid portion 18 of the backing member 8 rests against the doctor blade 7. The mid portion 18 of the backing member 8 bows away from the doctor blade 7, thus forming a cavity between these elements. A pressure-loaded hose 11 is adapted to rest against the backing member 8 at the upper end of its mid portion 18, just before the mid portion 18 deviates to form the loading tip 12, 10 pointed against the doctor blade 7. The tip edge 10 of the backing member 8 rests against the doctor blade 7 so as to provide a linear backing force. This design approach brings the pivotal joining point and the fixing point of the mid portion 18 to the base 13 of the backing member close to the plane of the doctor blade, thus reducing the movement of the backing member 8 with respect to the surface of the doctor blade 7 to a small value, whereby the relative proportion of friction force to the exerted loading force remains also small.

The loading control of the doctor blade 7 takes place in the following manner. The actual loading force control is effected by altering the pressure in the pressure-loaded hose 11 which rests against the backing member 8. Because the tip edge 10 of the backing member presses the doctor blade 7 very close to the tip line 9 where the doctor blade 7 runs on the web 16 being coated, that is, the tip line 9 of the doctor blade 7, the force imposed by the doctoring action on the doctor blade 8 is partially inflicted on the tip edge 10 of the backing member 7 and as the distance from the line of the doctor blade tip 9 to the line of by the backing member tip edge 10 is small, the deviation at the tip 9 of the doctor blade 7 due to a change in the loading remains small, and correspondingly, the bending moment acting on the blade 7 remains small, because the lever arm has a short length. Thus, the tip angle of the doctor blade 7 remains constant and the wear of the blade takes place tangentially with the web 16 being coated. As a result, the loading control operates with a constant tip angle.

The profile control of the doctor blade 7 occurs in a conventional manner by moving the segments of the doctor blade profile control beam 4 by means of the adjustment screws 6. Since the backing member 8 is divided by cuts 14 into narrow slats or segments 20, it conforms flexibly to the profile control when the shape of the profile control beam 4 is adjusted. The doctor blade profile control can be implemented by automatic or manual means, but owing to the extremely good control accuracy of the doctor blade profile by virtue of the backing member according to the invention, the benefits of automatic control can be optimally utilized.

The backing member 8 can be fabricated from a suitable material, e.g., an extruded aluminum or plastic section. Required stiffness-reducing cuts can be made by a number of alternative machining methods such as a cutting laser or high-pressure water jet. The shape and dimensions of the backing member proper can be varied as required. For instance, the backing member can be adapted floatingly behind the doctor blade, whereby the base 13 of the backing member 8 can be omitted. In this case, the backing member 8 has an L-shaped cross section, as shown in FIG. 4. Equally, the backing member can be fixed to any part of the doctor blade support assembly or loading apparatus provided that the backing-force-exerting line of the member is located close to the tip line of the doctor blade and a suitable means is arranged for pressing the backing member against the blade. The backing member should be resilient in the acting direction of the blade loading force, while in the vertical direction of the doctor blade the backing member should have such a high stiffness that no essential deformation can occur in this direction. Because essentially no forces are imposed on the backing member in this vertical direction, the required condition is fulfilled by all such backing member designs which have an essentially zero displacement vertically in the plane of the doctor blade.

Obviously, the design of the doctor blade beam and loading apparatus is dependent on the structure of the doctor blade support assembly in the concerned doctoring unit or short-dwell coater. The length of the backing member is made to extend at least over the web being coated.

The dimensioning of the backing member is naturally different for each doctoring unit construction and doctor blade holder design; however, for a 0.2–0.6 mm thick blade having the blade tip at a distance of approximately 30–100 mm, typically 40–70 mm, from the blade fixing point, the distance of the backing member tip from the doctor blade tip is typically 0.5–5 mm, advantageously 1–3 mm.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. An assembly for loading a doctor blade of a coater apparatus, comprising:

a doctor blade support beam;

a doctor blade mounted to said support beam and having a tip;

a backing member mounted to said support beam, a tip of said backing member adapted to rest against said doctor blade substantially adjacent to the doctor blade tip; and loading means for pressing said backing member against said doctor blade for providing a force for loading said doctor blade;

said backing member being divided along its longitudinal axis into segments by cuts transverse to the longitudinal axis, said cuts extending from the tip of the backing member, and said backing member being formed of a material sufficiently rigid to transfer the force applied by said loading means to said doctor blade tip, the material forming said backing member and the shape of said backing member being selected so as to substantially eliminate sliding movement between said doctor blade and the tip of said backing member when the loading of said doctor blade changes.

2. An assembly as defined in claim 1, wherein said backing member is pivotally mounted to said support beam proximate to where said doctor blade is mounted to said support beam.

3. An assembly as defined in claim 1, wherein said cuts are filled with a filling material which does not substantially affect the flexibility of the backing member.

4. An assembly as defined in claim 3, wherein said filling material is a silicone.

5. An assembly as defined in claim 3, wherein said filling material is a urethane polymer.

6. An assembly as defined in claim 1, wherein the backing member has a Z-shaped cross section formed of a base, a middle part connected at one end to the base, and a tip part connected to another end of the middle part so as to point in an opposite direction relative to the base, the tip part having an end that tapers to an edge suited for pressing against the doctor blade.

7. An assembly as defined in claim 1, wherein the backing member has an L-shaped cross section formed of a main part and a tip part suited for pressing against the doctor blade.

8. An assembly as defined in claim 1, wherein the coater apparatus is a short-dwell coater.

9. An assembly as defined in claim 1, wherein the thickness of the doctor blade is between 0.2 and 0.6 mm, and the distance between the backing member tip and the doctor blade tip is between 0.5 and 5 mm.

10. An assembly as defined in claim 1, wherein the thickness of the doctor blade is between 0.2 and 0.6 mm, and the distance between the backing member tip and the doctor blade tip is between 1.0 and 3 mm.

11. An assembly as defined in claim 1, wherein the loading means comprises a pressurizable expandable hose mounted to said doctor blade support beam.

12. An assembly for loading a doctor blade of a coater apparatus, comprising:

a doctor blade support beam;

a doctor blade mounted to said support beam and having a tip;

a backing member mounted to said support beam, a tip of said backing member adapted to rest against said doctor blade substantially adjacent to the doctor blade tip, a pivot point of said backing member adapted to rest against a portion of said doctor blade spaced apart from said doctor blade tip; and loading means for pressing said backing member about said pivot point against said doctor blade for providing a force for loading said doctor blade;

said backing member being divided along its longitudinal axis into segments by cuts transverse to the longitudinal axis, said cuts extending from the tip of the backing member, and said backing member being formed of a material sufficiently rigid to transfer the force applied by said loading means to said doctor blade tip, the material forming said backing member, the shape of said backing member and the position of said pivot point relative to said doctor blade being selected so as to substantially eliminate sliding movement between said doctor blade and the tip of said backing member when the loading of said doctor blade changes.

13. An assembly as defined in claim 12, wherein said cuts are filled with a filling material which does not substantially affect the flexibility of the backing member.

14. An assembly as defined in claim 13, wherein said filling material is a silicone.

15. An assembly as defined in claim 13, wherein said filling material is a urethane polymer.

16. An assembly as defined in claim 12, wherein the backing member has a Z-shaped cross section formed of a base, a middle part connected at one end to the base, and a tip part connected to another end of the middle part so as to point in an opposite direction relative to the base, the tip part having an end that tapers to an edge suited for pressing against the doctor blade.

17. An assembly as defined in claim 12, wherein the backing member has an L-shaped cross section formed of a main part and a tip part suited for pressing against the doctor blade.

18. An assembly as defined in claim 12, wherein the coater apparatus is a short-dwell coater.

19. An assembly as defined in claim 12, wherein the thickness of the doctor blade is between 0.2 and 0.6 mm, the distance between the doctor blade tip and portion of the doctor blade contacting the pivot point of the backing member is between 30 and 100 mm, and the distance between the backing member tip and the doctor blade tip is between 0.5 and 5 mm.

20. An assembly as defined in claim 12, wherein the thickness of the doctor blade is between 0.2 and 0.6 mm, the distance between the doctor blade tip and portion of the doctor blade contacting the pivot point of the backing member is between 40 and 70 mm, and the distance between the backing member tip and the doctor blade tip is between 1.0 and 3 mm.

21. An assembly as defined in claim 12, wherein the loading means comprises a pressurizable expandable hose mounted to said doctor blade support beam.

22. An assembly for loading a doctor blade of a coater apparatus, comprising:

a doctor blade support beam;

a doctor blade mounted to said support beam and having a tip;

a backing member mounted to said support beam, a tip of said backing member adapted to rest against said doctor blade substantially adjacent to the doctor blade tip; and loading means for pressing said backing member against said doctor blade for providing a force for loading said doctor blade;

said backing member being divided along its longitudinal axis into segments by cuts transverse to the longitudinal axis, and said backing member being formed of a material sufficiently rigid to transfer the force applied by said loading means to said doctor blade tip, the material forming said backing member and the shape of said backing member being selected so as to substantially eliminate sliding movement between said doctor blade and the tip of said backing member when the loading of said doctor blade changes, said cuts being filled with a filling material which does not substantially affect the flexibility of the backing member.

23. An assembly as defined in claim 22, wherein said filling material is a silicone.

24. An assembly as defined in claim 22, wherein said filling material is a urethane polymer.

25. An assembly for loading a doctor blade of a coater apparatus, comprising:

a doctor blade support beam;

a doctor blade mounted to said support beam and having a tip;

a backing member mounted to said support beam, a tip of said backing member adapted to rest against said doctor blade substantially adjacent to the doctor blade tip, a pivot point of said backing member adapted to rest against a portion of said doctor blade spaced apart from said doctor blade tip; and loading means for pressing said backing member about said pivot point against said doctor blade for providing a force for loading said doctor blade;

said backing member being divided along its longitudinal axis into segments by cuts transverse to the longitudinal axis, and said backing member being formed of a material sufficiently rigid to transfer the force applied by said loading means to said doctor blade tip, the material forming said backing member, the shape of said backing member and the position of said pivot point relative to said doctor blade being selected so as to substantially eliminate sliding movement between said doctor blade and the tip of said backing member when the loading of said doctor blade changes, said cuts being filled with a filling material which does not substantially affect the flexibility of the backing member.

26. An assembly as defined in claim 25, wherein said filling material is a silicone.

27. An assembly as defined in claim 25, wherein said filling material is a urethane polymer.

* * * * *